US006364166B1

(12) United States Patent
Ritsche et al.

(10) Patent No.: US 6,364,166 B1
(45) Date of Patent: Apr. 2, 2002

(54) DISPENSER WITH MANUALLY OPERABLE DISCHARGE DEVICE

(75) Inventors: Stefan Ritsche, Radolfzell; Gottfried Fuchs; Christa Wohriska, both of Steisslingen, all of (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 0 days.

(21) Appl. No.: 09/555,327

(22) PCT Filed: Nov. 12, 1998

(86) PCT No.: PCT/EP98/07257

§ 371 Date: Aug. 10, 2000

§ 102(e) Date: Aug. 10, 2000

(87) PCT Pub. No.: WO99/28042

PCT Pub. Date: Jun. 10, 1999

(30) Foreign Application Priority Data

Nov. 29, 1997 (DE) ..... 197 53 147

(51) Int. Cl.[7] ..... B67D 5/32
(52) U.S. Cl. ..... 222/153.13; 222/182; 222/384
(58) Field of Search ..... 222/153.13, 182, 222/321, 384

(56) References Cited

U.S. PATENT DOCUMENTS

| | | | | |
|---|---|---|---|---|
| 4,773,567 A | | 9/1988 | Stoody | 222/153 |
| 4,921,142 A | | 5/1990 | Graf et al. | 222/162 |
| 4,944,429 A | * | 7/1990 | Bishop et al. | 222/153 |

FOREIGN PATENT DOCUMENTS

| | | |
|---|---|---|
| DE | 1 868 294 | 10/1962 |
| DE | 70 05 606 | 2/1970 |
| DE | 70 20 175 | 5/1970 |
| DE | 24 18 720 | 10/1974 |
| DE | 28 45 966 | 4/1980 |
| DE | 31 00 786 A1 | 12/1981 |
| DE | 31 02 525 A1 | 12/1982 |
| DE | 33 42 883 A1 | 6/1985 |
| DE | 33 42 885 A1 | 6/1985 |
| DE | 35 08 568 A1 | 9/1986 |
| DE | 44 00 605 A1 | 7/1995 |
| DE | 44 17 486 A1 | 11/1995 |
| EP | 0 218 840 A2 | 8/1986 |
| FR | 2 686 305 | 4/1993 |
| WO | 96/24439 | 2/1996 |

* cited by examiner

*Primary Examiner*—Kevin Shaver
*Assistant Examiner*—Thach H Bui
(74) *Attorney, Agent, or Firm*—Quarles & Brady LLP

(57) ABSTRACT

For the discharge, particularly atomization of media, particularly liquid medicaments, a dispenser (11) is provided, which discharges a charge of the medicament in only one or optionally a few strokes. Actuation takes place between three fingers of the user, the thumb pressing an actuating pusher (80) in the actuating and discharge direction. In order to prevent an unintentional actuation and simultaneously protect the discharge opening (44) against dirtying and contamination, a protective cap (90) is provided, which covers the entire discharge section (13) and the holding surfaces (14) for actuation. It also has web-like projections (93) extending up to the actuating pusher (80) and securing the latter, which prevents an actuation when the protective cap is fitted. However, actuation is possible after removing the protective cap, which is secured by a snap connection.

12 Claims, 2 Drawing Sheets

DISPENSER WITH MANUALLY OPERABLE DISCHARGE DEVICE

FIELD OF APPLICATION AND PRIOR ART

The invention relates to a dispenser with a manually operable discharge device, particularly for the optionally atomized discharge of a charge in one or a few strokes.

Such a dispenser is known from EP 218 840 (corresponding to U.S. Pat. No. 4,921,142). It has a casing, a holding surface located thereon for supporting at least one finger and a discharge section with a discharge opening, e.g. of an atomizing nozzle, as well as with an actuating pusher for actuating the discharge device. It also has a removable protective cap covering the discharge opening. These protective caps are provided in order to prevent dirtying of the discharge opening, because usually such dispensers discharge pharmaceutical products.

The dispenser is actuated or operated with the thumb, which presses on the actuating pusher. The latter is substantially covered by the casing and is only accessible through a cutout, which roughly corresponds to the thumb profile to prevent it being unintentionally operated.

Such dispensers often contain medicaments, which are to be kept ready for immediate use by the patient. Thus, e.g. medicaments are applied to the nasal mucosa, because from there they enter the blood stream in the fastest and most compatible manner. In particular, medicaments for combatting migraine and other headaches are administered in this way.

As a result the patient must carry the dispenser. The danger exists that despite the protective jacket around the actuating pusher, an accidental actuation will take place, e.g. through articles in a handbag.

PROBLEM AND SOLUTION

The problem of the invention is to further improve such a dispenser with respect to the security against accidental actuation.

This problem is solved in that the protective cap has blocking means for blocking the actuating pusher.

Thus, the protective cap acquires a double function. On the one hand it covers the discharge opening and makes it possible to store or keep the dispenser without any risk of dirtying or contamination of the discharge opening, even in an environment where a dirtying risk exists, and on the other, by blocking the actuating pusher, ensures that for as long as it is mounted on the dispenser, an accidental actuation is impossible.

The protective cap is in any case removed for actuating the dispenser and frees the actuating pusher for operating purposes.

Particular preference is given to a construction in which the protective cap also covers the holding surface in actuation-preventing manner. In this case an accidental actuation prior to the removal of the protective cap is also prevented in that the user no longer finds a working surface for actuation. He can admittedly place the thumb on the actuating pusher, but finds no hold or support there, this normally being found on the holding surface by the index and middle fingers. This indicates to him that he must firstly remove the protective cap before actuation can take place. Even if he were to find a hold on the protective cap, this would not lead to an accidental actuation. The force introduction would remain within the protective cap, i.e. the force exerted on the actuating pusher would not be transferred to the casing and the discharge device.

It is pointed out that a tamper-proof seal for such dispensers is already described in WO 96/24439. This takes place by preset breaking material bridges between the casing and the functional unit movable on actuation and which comprises the actuating pusher, pump cylinder and optionally a sleeve receiving the pump cylinder. This tamper-proof seal, which simultaneously produces a pressure point ensuring complete discharge (minimum force), is also additionally usable in the case of the present invention. As the preset breaking force can be set in such a way that the dispenser is operable for use, it cannot prevent, but instead only indicate the accidental use. Therefore a combination of said pressure point/tamper-proof seal features with the security of actuation by the protective cap is appropriate and advantageous.

The invention can be used with particular advantage in connection with disposable atomizers or those discharging a charge or batch in a few successive strokes or stroke portions. However, if following an actuating phase the protective cap has to be refitted, then it is also appropriate for other dispensers designed for numerous strokes. The dispenser is suitable for dispensing flowable media, particularly liquid pharmaceuticals in atomized or droplet-dosed form.

These and further features can be gathered from the claims, description and drawings and the individual features, either singly or in the form of subcombinations, can be implemented in an embodiment of the invention and in other fields and can represent advantageous, independently protectable constructions for which protection is hereby claimed. The subdivision of the application into individual sections and the subtitles in no way restrict the general validity of the statements made thereunder.

BRIEF DESCRIPTION OF THE DRAWINGS

An embodiment of the invention is described in greater detail hereinafter relative to the drawings, wherein show:

FIG. 3 A view from below of a dispenser with a protective cap.

DESCRIPTION OF THE PREFERRED EMBODIMENTS

Figures 1, 2:
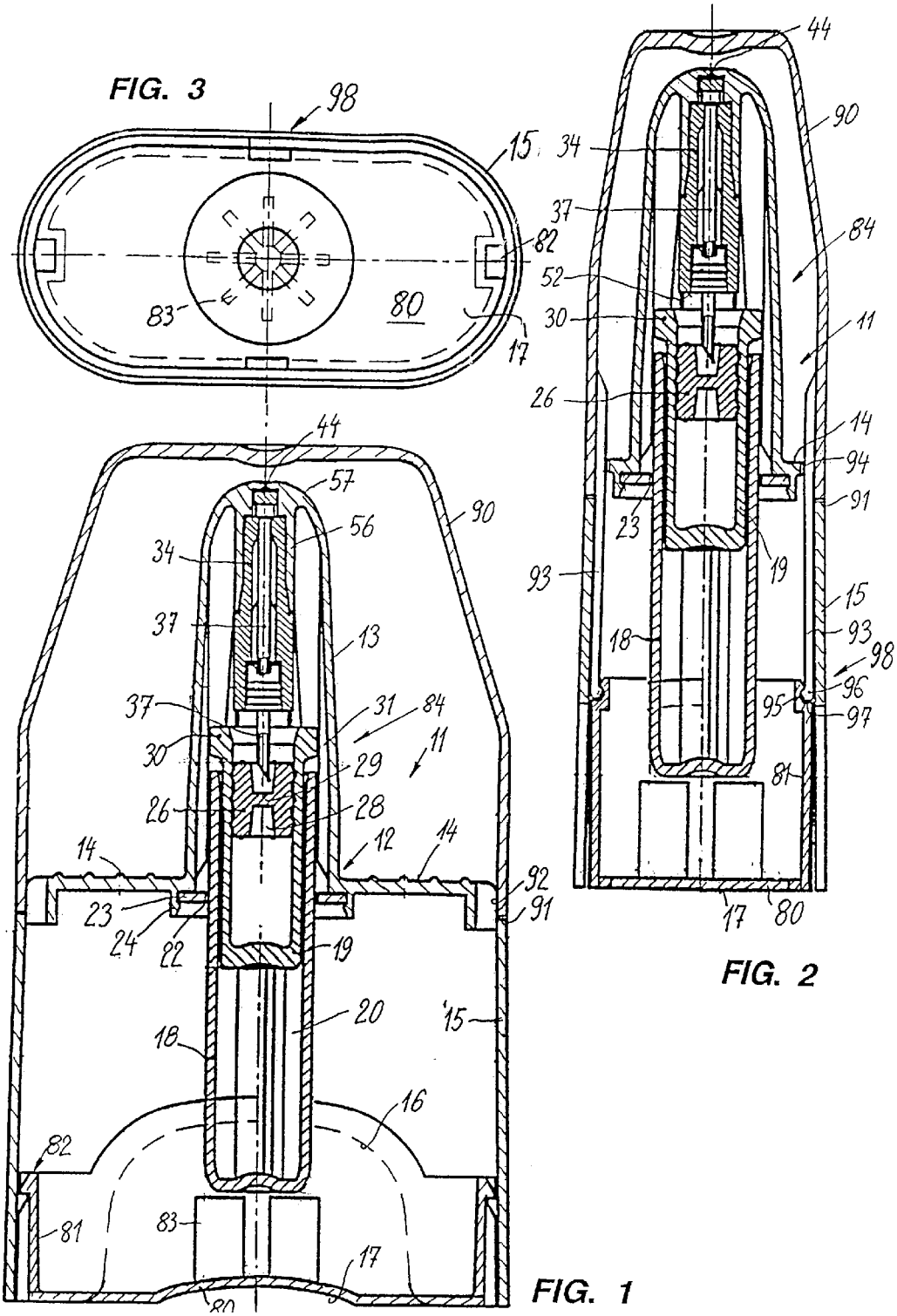
FIGS. 1 & 2 Longitudinal sections along lines I and II in FIG. 3.

The dispenser 11 shown in FIGS. 1 to 3 is a disposable atomizer discharging its entire charge in one stroke. It has a casing 12 provided with an elongated discharge section 13. It projects centrally from an epaulette-like holding surface 14 of the casing, which projects to two sides and is oval in plan view. To the outer edge of the holding surface 14 is connected a casing jacket 15 directed in opposition to the discharge section 13 and which has on its flatter sides in each case one actuating cutout 16. The space formed by the casing jacket 15 is terminated downwards by an actuating pusher 80, whose underside forms an actuating surface 17. The actuating pusher 80 has an inverted dish or cap shape with a jacket 81, engaging in the casing jacket 15 and connected to the actuating surface 17. It is secured against removal by means of barb-like, interengaging snap-action elements 82 on the casing jacket 15. The jacket 81 from there covers the actuating cutout 16.

By means of webs 83 the actuating pusher 80 presses on a sleeve 18, which receives a glass ampoule 19, also supported by webs 20 in the sleeve. This ampoule on the one hand forms the reservoir for the liquid or pasty medium; 50 to be discharged and on the other a pump cylinder for a discharge device 84 operating in the manner of a thrust piston pump. The sleeve 18 and ampoule 19 are in the form of elongated, deep, circular cylindrical containers.

Onto the plastic sleeve is shaped by means of web-like material bridges 22 forming thin preset breaking points, a ring 23, which is received in a snap connection 24 on the underside of the casing holding surfaces 14.

The ampoule 19 is terminated by a rubbery material sealing plug 26, which engages in sealing manner on the circular cylindrical ampoule wall. It is elongated and from each of its faces has central recesses 28 separated by a central web 29. The latter forms a perforatable membrane. The sleeve 18 and ampoule 19 project centrally into the inner space of the discharge section 13. The outer wall of the sleeve 18 and an upper flange 30 of the ampoule 19 is guided on lateral webs 31 in the inner space of the discharge section 13 over the entire length of its actuating path.

The slightly conical, but mainly cylindrical, elongated discharge section 13 is bounded at the top by a hemispherical end 57. The discharge opening 44 in the form of a spraying nozzle is centrally provided there.

A piston shaft 34 projects from the end 57 into the interior of the discharge section 13 and is pressed into a connection 56 in the interior of said discharge section 13. In its central bore said hollow shaft guides a steel needle 37, whose sharpened end is directed onto the web 29 in the sealing plug or piston 26.

Over the dispenser 11 can be inverted a protective cap 90 covering the entire discharge section 13 and the holding surfaces 14. The protective cap, which like most parts of the dispenser is made from plastic, has its surface area adapted to the oval shape of the holding surfaces 14 and from there forms a dome-like, upwardly tapering, closed space. The lower edge 91 of said protective cap dome engages over a marginal recess 92 on the casing, so that in the fitted state the protective cap forms a continuous extension of the casing jacket 15. This leads to a body having a shape similar to a pocket lighter and which can consequently be easily transported and handled.

Onto the inside of the protective cap are shaped two lateral projections 93, which project downwards in web-like manner from the centre of the flat sides, namely through cutouts 94. Each engages in a recess 95 on the upper edge of the jacket 81 of the actuating pusher and are secured there by a releasable snap connection 96. They secure the protective cap against an excessively easy upward removal. However, their ends 97 are simultaneously supported in the recess 95 and consequently form blocking aids 98 which, when the protective cap is fitted, prevent an upward movement of the actuating pusher 80, i.e. in the actuating direction.

The dispenser filled with a pharmaceutical as the medium 50 is supplied with the protective cap 90 fitted. In this form an actuation is impossible, because a movement of the actuating pusher 80 is prevented by the blocking means 98. In the case of pressure on the actuating pusher 80, the latter is supported by means of its recess 95 on the ends 97 of the projections 93, which transfer the force to the protective cap . Due to the fact that the protective cap covers the entire upper section of the dispenser, i.e. not only the discharge section 13, but also holding surfaces 14, no opposing force can build up, which could act between the casing and the actuating pusher and therefore initiate an actuation. There is a complete frictional connection between the actuating pusher and the protective cap and the casing remains free from actuating forces.

If, after overcoming the holding force of the snap connection 96, the protective cap 90 is removed from the casing by drawing off in the upwards direction, the dispenser is ready to operate. The user can now apply the index finger and middle finger to the holding surfaces 14 and press with the thumb on the actuating surface 17 of the pusher 18. Prior to the start of the upward movement of the functional unit constituted by sleeve 18/ampoule 19/piston 26, it is necessary to overcome a pressure point, whose magnitude is determined by the preset breaking force of the material bridges 22. This ensures that the discharge is commenced with an adequate pressure and can be performed in one stroke. This is followed by the upward movement of the sleeve 18 via the webs 43 and the ampoule 19 via the webs 20. The needle 37 perforates the web 29 of the sealing plug 26 and provides a connection to the discharge opening 44. The lower face 52 of the piston shaft 34 strikes the top of the sealing plug and presses the latter as a pump piston into the ampoule 19, so that the discharge device operates as an irreversible thrust piston pump and the medium is sprayed through the discharge opening 44 with a force predetermined by the pressure point function.

It is clear that the protective cap 90 makes the dispenser into an easily handlable and operable instrument, which can be transported by the patient without any risk of dirtying or undesired actuation and is immediately ready to operate by removing the protective cap. As a result of the progressive design shape, supplementing the casing, of the protective cap not only an esthetic design, but also one making the function clear to the user is provided.

Figure 4:
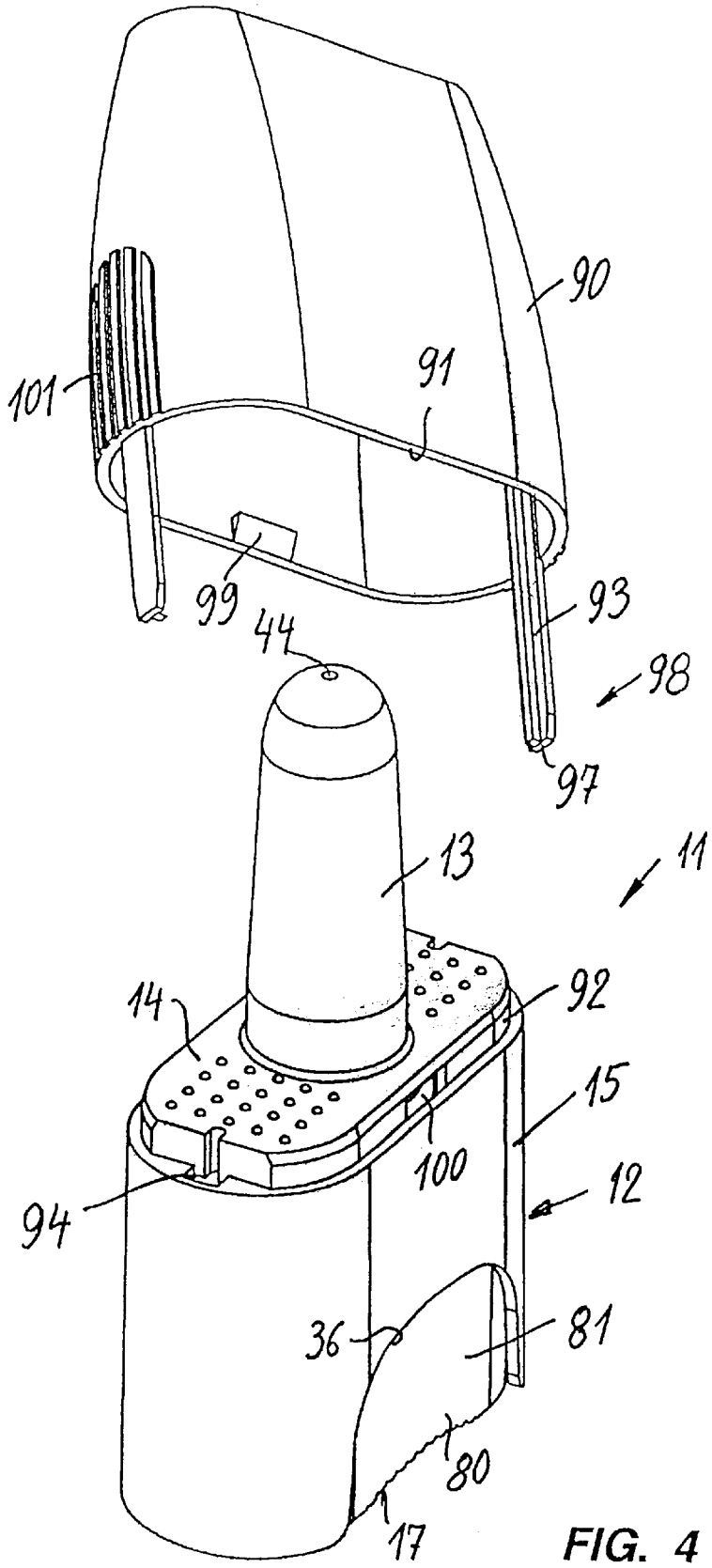
FIG. 4 A perspective, exploded view of a dispenser.

The dispenser 11 perspectively shown in FIG. 4 corresponds in all details and also the function to that according to FIGS. 1 to 3. The web-like projections 93 forming the blocking means 98 are merely displaced here from the centre of the flat sides to the round narrow sides of the protective cap. At their ends 97 projections 93 are constructed as through T-shaped webs instead of having a snap connection and said webs engage in cutouts 94 in the casing. The removal of the protective cap 90 from the casing 12 is prevented by detents 99 in the centre of the flat insides of the protective cap 90. The detents 99 engage in corresponding recesses 100 in the vicinity of the circumferential marginal recess 92 of the casing and secure the protective cap in barb-like manner. It is consequently secured against removal from the casing, which further improves the blocking of the actuating pusher.

In order to be able to remove the protective cap, the user presses on pressure surfaces 101 having corrugations indicating this actuation. He somewhat compresses the protective cap, so that the barb-like detents 99 are released from the recesses 100 by a corresponding widening of the oval profile of the protective cap and the latter can be removed.

What is claimed is:

1. Dispenser with a manually operable discharge device (84), said dispenser comprising a casing (12), a holding surface (14) provided thereon for supporting at least one finger of an operator and a discharge section (13) with a discharge opening (44) at a first side of the dispenser, and an actuating pusher (80) for actuating the discharge device (84), said pusher being provided on a second side of the dispenser (11) remote from the discharge opening (44) and opposite to said first side and the dispenser having a protective cap (90) for blocking the actuating pusher (80).

2. Dispenser according to claim 1, wherein the protective cap (90) covers the holding surface (14) in actuation-preventing manner.

3. Dispenser according to claim 1, wherein the blocking means (98) have at least one projection (93) emanating from the protective cap (90) and which cooperates with the actuating pusher (80), locking the actuation pusher in the actuating direction.

4. Dispenser according to claim 1, wherein the protective cap (90) is fixed by means of a snap fastener (96,99,100) to the casing (12).

5. Dispenser according to claim 1, wherein the discharge device (84) comprises a thrust piston pump, whose pump cylinder (19) is the reservoir for a medium to be discharged, which reservoir is inserted in a sleeve (18).

6. Dispenser according to claim 1, wherein the discharge device (84) is constructed as a thrust piston pump having a piston, which is formed by a perforatable sealing plug (26) forming a closure for the pump cylinder of the thrust piston pump and which is to be urged by a shaft (34) mounted in the discharge section (13) in irreversible manner into the pump cylinder and is perforatable by a needle (37) held in the shaft (34).

7. Dispenser according to claim 1, further comprising pressure point means containing preset breaking material bridges (22) functionally arranged between the casing (12) and a functional unit, said pressure point means being movable during actuation and comprising the actuating pusher (80) and pump cylinder (19).

8. Dispenser according to claim 1, wherein the holding surface (14) has an elongated shape, in whose center projects the discharge section (13), and that the protective cap covers the discharge section (13) with a downwardly open dome section and that on the lower edge (91) of the dome section are shaped the blocking means (98) in the form of two downwardly projecting, strip-like projections (93) facing one another with respect to the dome section.

9. Dispenser according to claim 1, wherein the dispenser is designed for the optionally atomized discharge of a charge in only one or a few strokes.

10. Dispenser according to claim 4, wherein the snap fastener is provided on the projection (93) and in particular the projection (93) engages in the interior of the casing (12).

11. Dispenser with a manually operable discharge device (84), said dispenser comprising a casing (12), a holding surface (14) provided thereon for supporting at least one finger of an operator and a discharge section (13) with a discharge opening (44), and an actuating pusher (80) being disposed on a side of the dispenser (11) that is remote from the discharge opening (44) for actuating the discharge device (84), the dispenser having a protective cap (90) removable prior to discharge actuation, the protective cap covering the discharge opening (44), and having blocking means (98) for blocking the actuating pusher (80), the protective cap (90) covering the holding surface (14) in an actuation-preventing manner.

12. Dispenser with a manually operable discharge device (84) connectable to a media reservoir, said dispenser comprising a casing (12), a holding surface (14) provided thereon for supporting at least one finger of an operator and a discharge section (13) with a discharge opening (44), and an actuating pusher (80) being provided on a side of the dispenser (11) that is remote from the discharge opening (44) for actuating the discharge device (84), the dispenser having a protective cap (90) removable prior to discharge actuation, wherein said protective cap covers the discharge opening (44), and has blocking means (98) for blocking the actuating pusher (80), said blocking means (98) projecting alongside the reservoir towards the pusher, and wherein said pusher is movable in a direction towards the discharge opening (44).

* * * * *

UNITED STATES PATENT AND TRADEMARK OFFICE

CERTIFICATE OF CORRECTION

PATENT NO. : 6,364,166 B1 
DATED : April 2, 2002
INVENTOR(S) : Stefan Ritsche, Gottfried Fuchs and Christa Wohriska It is certified that error appears in the above-identified patent and that said Letters Patent is hereby corrected as shown below:

Column 1,
Line 35, the heading "PROBLEM AND SOLUTION" should be -- SUMMARY OF THE INVENTION --

Signed and Sealed this

Fifth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,364,166 B1 
DATED : April 2, 2002
INVENTOR(S) : Stefan Ritsche, Gottfried Fuchs and Christa Wohriska It is certified that error appears in the above-identified patent and that said Letters Patent is hereby corrected as shown below:

Drawings,
Fig. 5, please add as shown below:

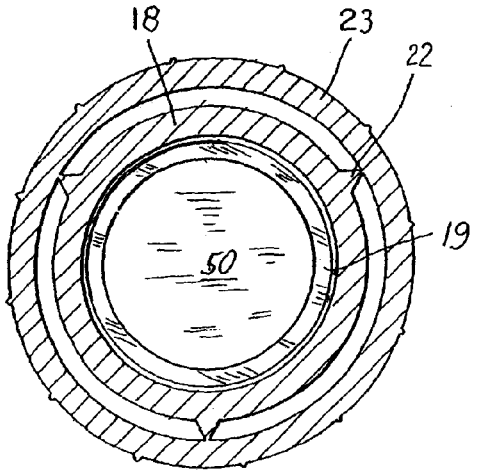

FIG. 5

Column 1,
Line 42, insert -- FIG. 5 is detail cross-section along lines V--V in FIG. 1. --

Signed and Sealed this

Twenty-eighth Day of September, 2004

JON W. DUDAS
*Director of the United States Patent and Trademark Office*